US009217626B1

(12) United States Patent
Hajjar

(10) Patent No.: US 9,217,626 B1
(45) Date of Patent: Dec. 22, 2015

(54) SHOTSHELL AND COOPERATING FIRING SYSTEM

(71) Applicant: Snake River Machine, Inc., Meridian, ID (US)

(72) Inventor: Jeffrey Hajjar, Middleton, ID (US)

(73) Assignee: SNAKE RIVER MACHINE, INC., Meridian, ID (US)

( * ) Notice: Subject to any disclaimer, the term of this patent is extended or adjusted under 35 U.S.C. 154(b) by 0 days.

(21) Appl. No.: 14/599,217

(22) Filed: Jan. 16, 2015

(51) Int. Cl.

| | |
|---|---|
| ***F42B 7/02*** | (2006.01) |
| ***F42B 7/04*** | (2006.01) |
| ***F41C 7/00*** | (2006.01) |
| ***F42B 33/02*** | (2006.01) |

(52) U.S. Cl.
CPC ... *F42B 7/04* (2013.01); *F41C 7/00* (2013.01); *F42B 33/02* (2013.01)

(58) Field of Classification Search
CPC ..... F42B 7/08; F42B 7/04; F42B 7/046
USPC ..... 102/448–463
See application file for complete search history.

(56) References Cited

U.S. PATENT DOCUMENTS

| | | | | | |
|---|---|---|---|---|---|
| 3,127,836 | A * | 4/1964 | Silva | 102/430 |
| 3,293,979 | A * | 12/1966 | Woodring et al. | 86/36 |
| 3,429,262 | A * | 2/1969 | Kincheloe et al. | 102/438 |
| 4,702,170 | A * | 10/1987 | Trudeau | 102/446 |
| 5,000,094 | A * | 3/1991 | Sullivan | 102/439 |
| 5,363,769 | A * | 11/1994 | Bellak et al. | 102/446 |
| 8,220,393 | B2 * | 7/2012 | Schluckebier et al. | 102/448 |
| 8,985,004 | B2 * | 3/2015 | DeJong | 89/125 |
| 2004/0112243 | A1 * | 6/2004 | Amick | 102/517 |
| 2005/0034558 | A1 * | 2/2005 | Amick | 75/228 |
| 2010/0101444 | A1 * | 4/2010 | Schluckebier et al. | 102/448 |
| 2012/0132099 | A1 * | 5/2012 | Busky et al. | 102/336 |

* cited by examiner

*Primary Examiner* — Samir Abdosh
(74) *Attorney, Agent, or Firm* — Marshall, Gerstein & Borun LLP

(57) ABSTRACT

A non-centerfire shotgun designed to operate with a non-centerfire shotshell, wherein a conventional shotshell is not able to be fired from the non-centerfire shotgun.

23 Claims, 5 Drawing Sheets

SHOTSHELL AND COOPERATING FIRING SYSTEM

TECHNICAL FIELD

The invention relates generally to the field of shotguns and shotshell ammunition, and more specifically to a less-lethal shotgun and less-lethal shotshell ammunition.

BACKGROUND

Conventional shotshells, i.e., shotgun shells, are centerfire ammunition with the primer centrally located within the end of the brass portion or case-head. When the firing pin impacts the primer, the primer compound explodes to ignite the powder charge within the shotshell and the projectile is expelled from the hull body. Shotshell ammunition is available in different gauges and load types for a variety of purposes, for example, for use with a lethal or non-lethal weapon. A non-lethal weapon may also be called a less-lethal weapon, a less-than-lethal weapon, a non-deadly weapon, a compliance weapon, or a pain-inducing weapon and is a weapon intended to be less likely to kill a living target than a conventional weapon. Although a severe casualty or death may result whenever force is applied, a less-lethal weapon is intended to minimize that risk.

Military, police, and security forces may employ a conventional shotgun with less-lethal shotshells for self-defense, refugee control, crowd control, riot control, and prisoner control. The construction of the customary less-lethal shotshell is essentially identical to the conventional lethal shotshell except that the less-lethal shotshell includes less powder charge, and/or the projectile of the less-lethal shotshell is made of a low-density material, such as rubber. Because less-lethal and lethal shotshells are similarly constructed, both types of shotshells are capable of being fired from a conventional shotgun. This may pose a dangerous situation to a user of a conventional shotgun using less-lethal shotshells in a less-lethal situation if the user loses possession of the conventional centerfire shotgun to someone with access to lethal shotshells. A need therefore exists for a less-lethal shotgun and compatible less-lethal shotshell, wherein conventional lethal shotshells are not able to be used with the less-lethal shotgun.

SUMMARY

The present invention is directed to a non-centerfire shotgun specifically designed to operate with a non-centerfire shotshell, wherein a conventional shotshell is not able to be fired from the non-centerfire shotgun. In particular, a non-centerfire shotgun is able to fire a less-lethal non-centerfire shotshell, but is not able to fire a conventional centerfire shotshell.

In accordance with one example embodiment, the present invention is directed to a shotshell for cooperative operation with a non-centerfire shotgun including a non-centerfire firing assembly, the shotshell includes a case head including a non-centerfire primer assembly; a hull body attached to the case head; a powder charge disposed within the shotshell proximate the non-centerfire primer assembly; and a projectile housed within the hull body, wherein the powder charge is capable of being ignited when the non-centerfire shotshell is loaded within the non-centerfire shotgun and the non-centerfire primer assembly is struck by the non-centerfire firing assembly.

In accordance with another example embodiment, the present invention includes a non-centerfire firing assembly for facilitating use of a non-centerfire shotshell having a non-centerfire primer assembly with a non-centerfire shotgun having a trigger assembly, the firing assembly comprises: a bolt; and a striker extending through the bolt, wherein the firing assembly is configured to align the striker for striking the non-centerfire primer assembly of the non-centerfire shotshell when the non-centerfire shotshell is loaded in the shotgun and in response to actuation of the trigger assembly.

In accordance with another example embodiment, the present invention is directed to non-centerfire shotgun for firing a non-centerfire shotshell including a non-centerfire primer assembly in response to actuation of a trigger assembly, the shotgun comprises: a firing assembly configured to align a striker for striking the non-centerfire primer assembly of the non-centerfire shotshell when the non-centerfire shotshell is loaded in the shotgun.

In accordance with another example embodiment, the present invention is directed to a method of manufacturing a less-lethal non-centerfire shotshell for use with a shotgun including a non-centerfire firing assembly, the method comprises: providing a shotshell including a case head and a hull body; adapting a non-centerfire primer assembly to the case head; disposing a powder charge within the shotshell; and disposing a projectile within the hull body.

BRIEF DESCRIPTION OF THE DRAWINGS

The figures described below depict various aspects of the apparatuses and methods disclosed herein. It should be understood that each figure depicts an embodiment of a particular aspect of the disclosed apparatuses and methods, and that each of the figures is intended to accord with a possible embodiment thereof. Further, wherever possible, the following description refers to the reference numerals included in the following figures, in which features depicted in multiple figures are designated with consistent reference numerals.

DETAILED DESCRIPTION

Figure 1:
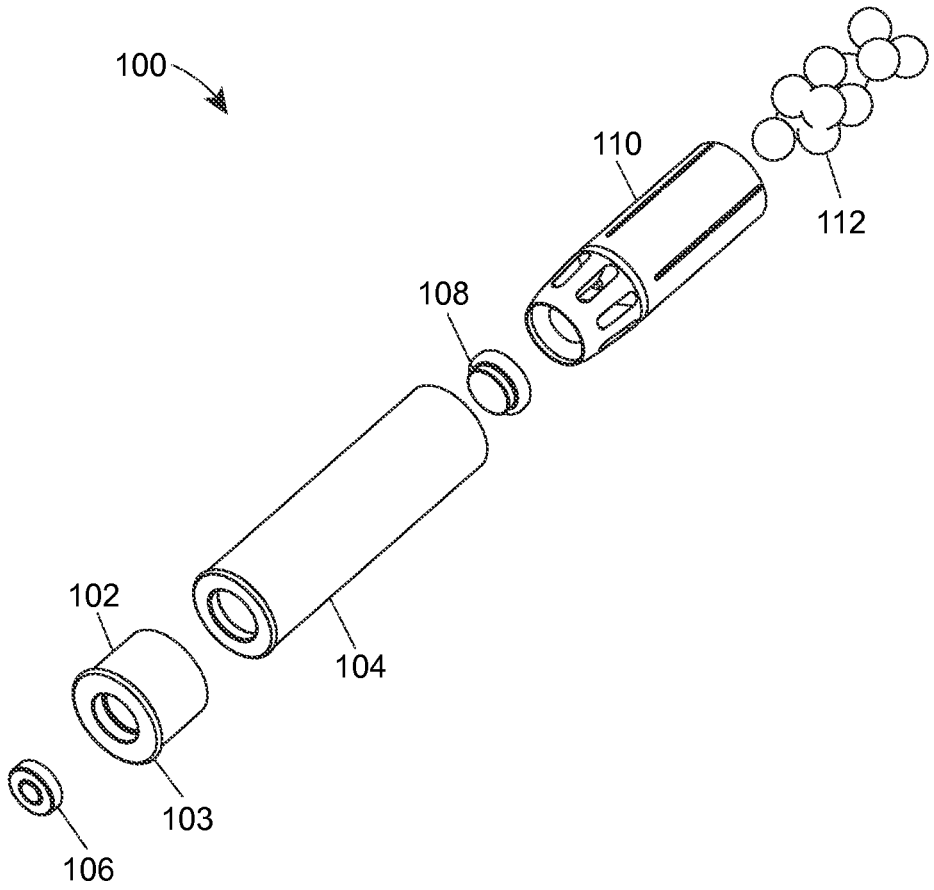
FIG. 1 is an exploded view of one embodiment of a non-centerfire shotshell of the present invention described herein.

FIG. 1 is an exploded view of one embodiment of a non-centerfire shotshell 100 of the present invention. The shotshell 100 includes a case head 102 having a first end and a second end. The case head 102 includes a rim 103 proximate the first end. A hull body 104 is attached to the case head proximate the second end. A non-centerfire primer assembly 106 is configured within the case head 102 proximate the first end and a powder charge 108 is disposed within the shotshell 100 proximate the non-centerfire primer assembly 106. A wad 110 may be positioned within the hull body 104 proximate the powder charge 108. The wad 110 provides a gas seal to prevent the powder charge 108 from mixing with a projectile 112 and blowing through the projectile 112 rather than propelling the projectile 112. The wad 110 may also provide a protective cup for containing the projectile 112 until it exits the barrel of the shotgun.

Depending on the intended use of the shotshell 100, the powder charge 108 may be of a type and amount appropriate for a lethal or less-lethal purpose. For a less-lethal application, the projectile 112 may include a non-metal material, e.g., polymer, rubber; of varying shapes and sizes, e.g., spheres, bean bag. Similarly, the hull body 104 may include an indicator such as a shape or description denoting that the shotshell 100 is intended for use in less-lethal situations. For example, the exterior surface of the hull body 104 may include a visible and/or tangible identifier such as a color, symbol, and/or a textured pattern, for example, a multi-sided geometric shape such as an octagonal-shaped circumference, stripes, and/or tactile cross-hatching.

Figure 2:
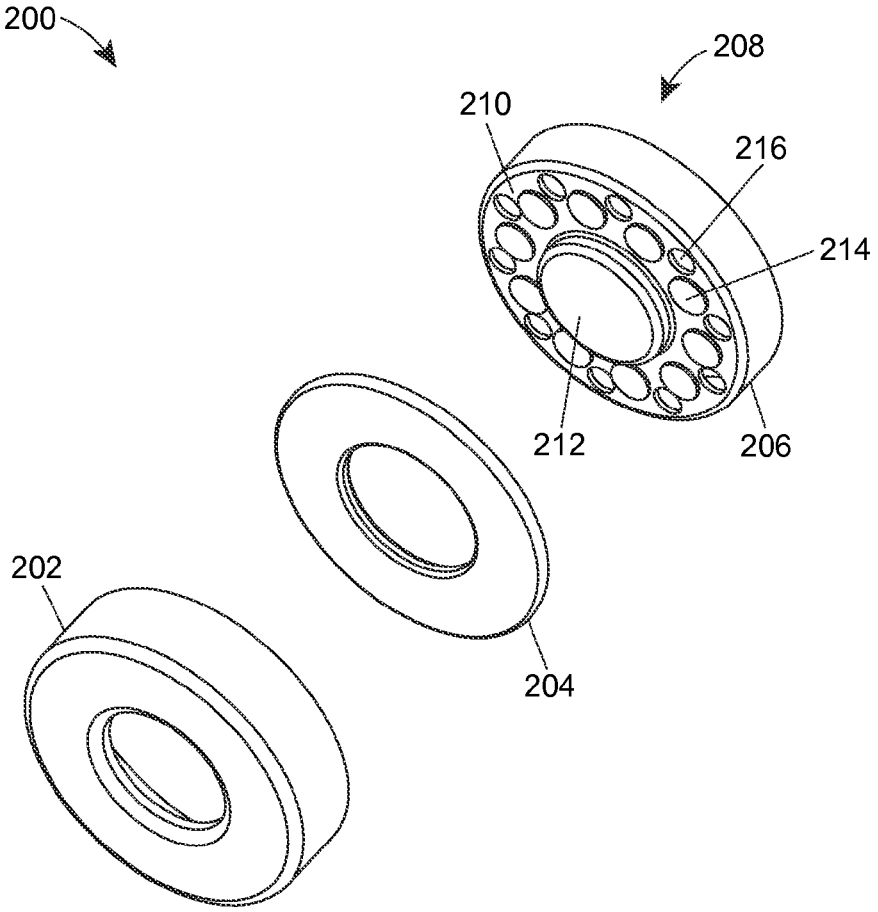
FIG. 2 is an exploded view of one embodiment of the non-centerfire primer assembly of the non-centerfire shotshell shown in FIG. 1.

FIG. 2 depicts one embodiment 200 of the non-centerfire primer assembly 106 shown in FIG. 1. The non-centerfire primer assembly 200 includes a non-centerfire configuration having of a primer cap or cup 202, a primer compound 204, and a primer base 206 or anvil. The primer compound 204 and the primer base 206 may reside within the primer cap 202, wherein the primer compound 204 is disposed between the primer cap 202 and the primer base 206. The primer base 206 includes a disc 208 having an annular incendiary portion 210 and an inert portion 212. The annular incendiary portion 210 of the primer base 206 is linearly aligned with a strike portion of the primer cup 202. The inert portion 212 of the primer base 206 includes an outer perimeter that may be substantially the same dimension and adjacent to an inner circumference of the annular incendiary portion 210. The inert portion 212 of the primer base 206 may or may not be linearly aligned with a non-strike portion of the primer cap 202. The incendiary portion 210 and the inert portion 212 of the primer base 206 may each lie within the same plane or one portion may lie within one plane and the other portion may lie within another plane.

In the embodiment shown in FIG. 2, the inert portion 212 lies in a different plane than that of the incendiary portion 210, wherein the inert portion 212 extends through the opening of the annular primer compound 204. The incendiary portion 210 of the primer base 206 includes at least one raised or protruding portion 214, e.g., dimple or projection; extending toward the primer compound 204 and the primer cap 202. The incendiary portion 210 also includes at least one through-hole 216 that facilitates the positioning of a portion of the primer compound 204 next to the powder charge 108 substantially disposed within the hull body 104 as shown in FIG. 1. The dimple 214 facilitates an explosion of the primer compound 204 that is caused by the non-centerfire firing assembly of a shotgun striking the strike portion of the primer cap 202 and thus crushing the primer compound 204 against one or more dimples 214 of the primer base 206. The explosion of the primer compound 204 then ignites the adjacent powder charge 108 that extends through the one or more through-holes 216.

The dimples 214 and through-holes 216 of the primer base 206 may include a variety of shapes and sizes that are sufficiently positioned on and/or within the washer-like plane of the incendiary portion 210 of the primer base 206 to ensure cooperation with the non-centerfire firing assembly of a cooperating shotgun. For example, the dimples 214 and through-holes 216 are of sufficient size and shape to ensure that the striker, e.g., firing pin, hammer; of the cooperating non-centerfire shotgun will impact the strike portion of the primer cap 202 and compress a portion of the primer compound 204 against at least one dimple 214 regardless of the rotational orientation of a loaded non-centerfire shotshell 100 with respect to the firing pin; and that the location of at least one through-hole 216 will be sufficiently near the explosion resulting from the primer compound 204 being compressed between the strike portion of the primer cap 202 impacted by the striker of the non-centerfire firing assembly and the incendiary portion 210 of the primer base 206 to ensure that the adjacent powder charge 108 accessible via the through-hole 216 ignites.

It can be readily observed that the annular, ring-like non-centerfire configuration of the primer assembly 200, e.g., absence of primer compound 204 atop or over the inert portion 212 of the primer base 206; is incapable of facilitating an explosion of the primer compound 204 and/or igniting the powder charge 108 in response to a striker striking the center of the primer cap 202 and ultimately impacting the inert portion 212 of the primer base 206. The non-centerfire shotshell 100 depicted in FIG. 1 is therefore incapable of being fired from a conventional centerfire shotgun.

Figure 3:
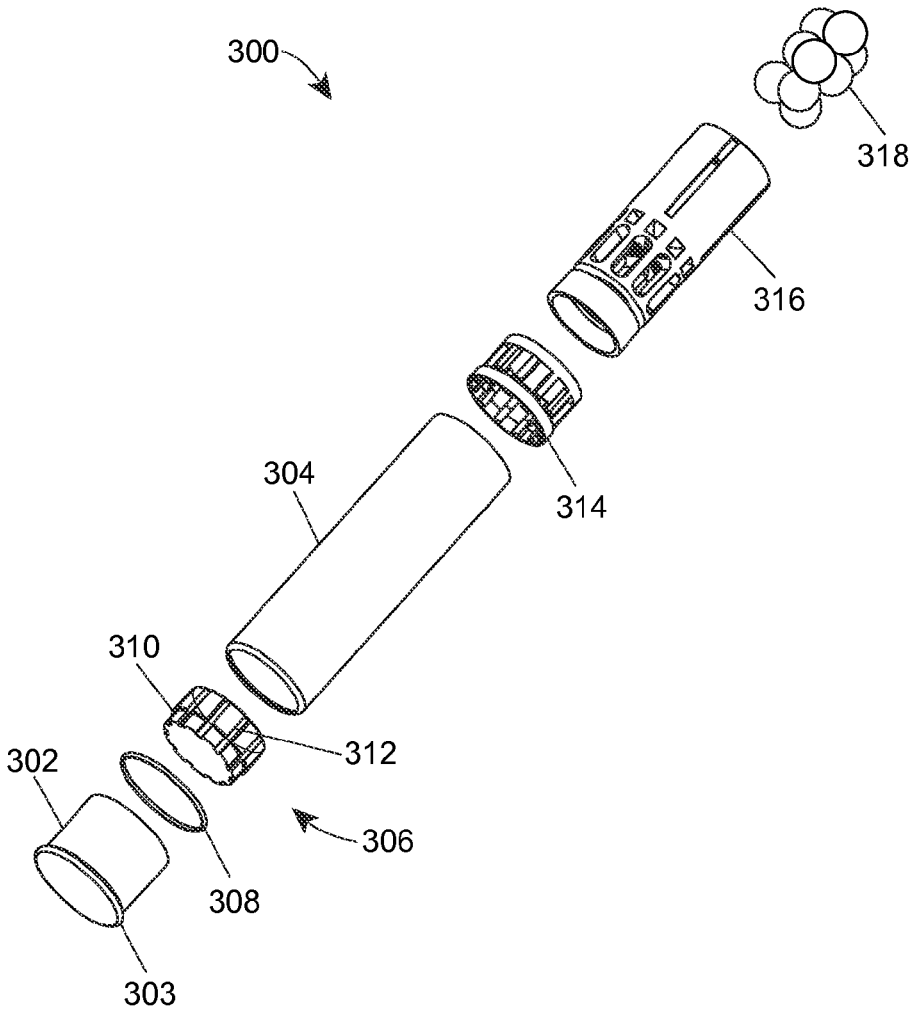
FIG. 3 is an exploded view of another embodiment of a non-centerfire shotshell of the present invention described herein.

An exploded view of an alternate embodiment of a non-centerfire shotshell 300 of the present invention is shown in FIG. 3. The shotshell 300 includes a case head 302 having a first end and a second end, wherein the second end of the case head 302 is attached to a hull body 304. The shotshell 300 includes a primer assembly 306 preferably housed within the case head 302 and includes a rim 303, a rimfire primer compound 308, and a slotted base wad 310. The rimfire primer compound 308 is preferably encapsulated in the case head 302 near the rim 303 proximate the first end of the case head 302. The slotted base wad 310, which includes at least one slot 312, may be a separate component pressed into the case head 302 and/or the hull body 304, or the slotted base wad 310 may be integral to the case head 302 and/or hull body 304. A powder charge 314 is disposed within the shotshell 300 and positioned proximate the primer assembly 306. In particular, the powder charge 314 is disposed within one or more slots 312 of the slotted base wad 310 and proximate the rimfire primer compound 308. The slots 312 of the slotted base wad 310 allow the powder charge 314 to contact the rimfire primer compound 308. The rim 303 facilitates an explosion of the primer compound 308 that is caused by the non-centerfire firing assembly of a shotgun striking the rim 303 and crushing the primer compound 308 therein. The explosion of the primer compound 308 then ignites the adjacent powder charge 314 extending through the one or more slots 312.

The slots 312 of the slotted base wad 310 may include a variety of shapes and sizes that are sufficiently positioned proximate the outer surface of the slotted base wad 310, which is adjacent to the inner diameter of the case head 302. The slots 312 are of sufficient size and shape to ensure that when the striker, e.g., firing pin, of the cooperating non-centerfire shotgun impacts the case head 302 near the rim 303 and compresses a portion of the primer compound 308 within the rim 303 regardless of the rotational orientation of a loaded non-centerfire shotshell 300 with respect to the firing pin, the location of at least one slot 312 will be sufficiently near the explosion resulting from the compressed primer compound 308 to ensure that the powder charge 314 accessible via the nearest slot 312 ignites.

A wad 316 may be disposed within the hull body 304 proximate the powder charge 314. The wad 316 provides a gas seal to prevent the powder charge 314 from mixing with a projectile 318 and blowing through the projectile 318 rather than propelling the projectile 318. The wad 316 may also provide a protective cup for containing the propelled projectile 318 until it exits the barrel of the shotgun.

It can be readily observed that the "rimfire" primer assembly 306, for example, rim 303, rimfire primer compound 308, and slotted base wad 310; is absent any structure that is capable of facilitating an explosion of the rimfire primer compound 308 and/or igniting the powder charge 314 in response to an impact received from a striker at the center of the base of the case head 302 illustrated in FIG. 3. The shotshell 300 depicted in FIG. 3 is therefore incapable of being fired from a conventional centerfire shotgun.

Figure 4:
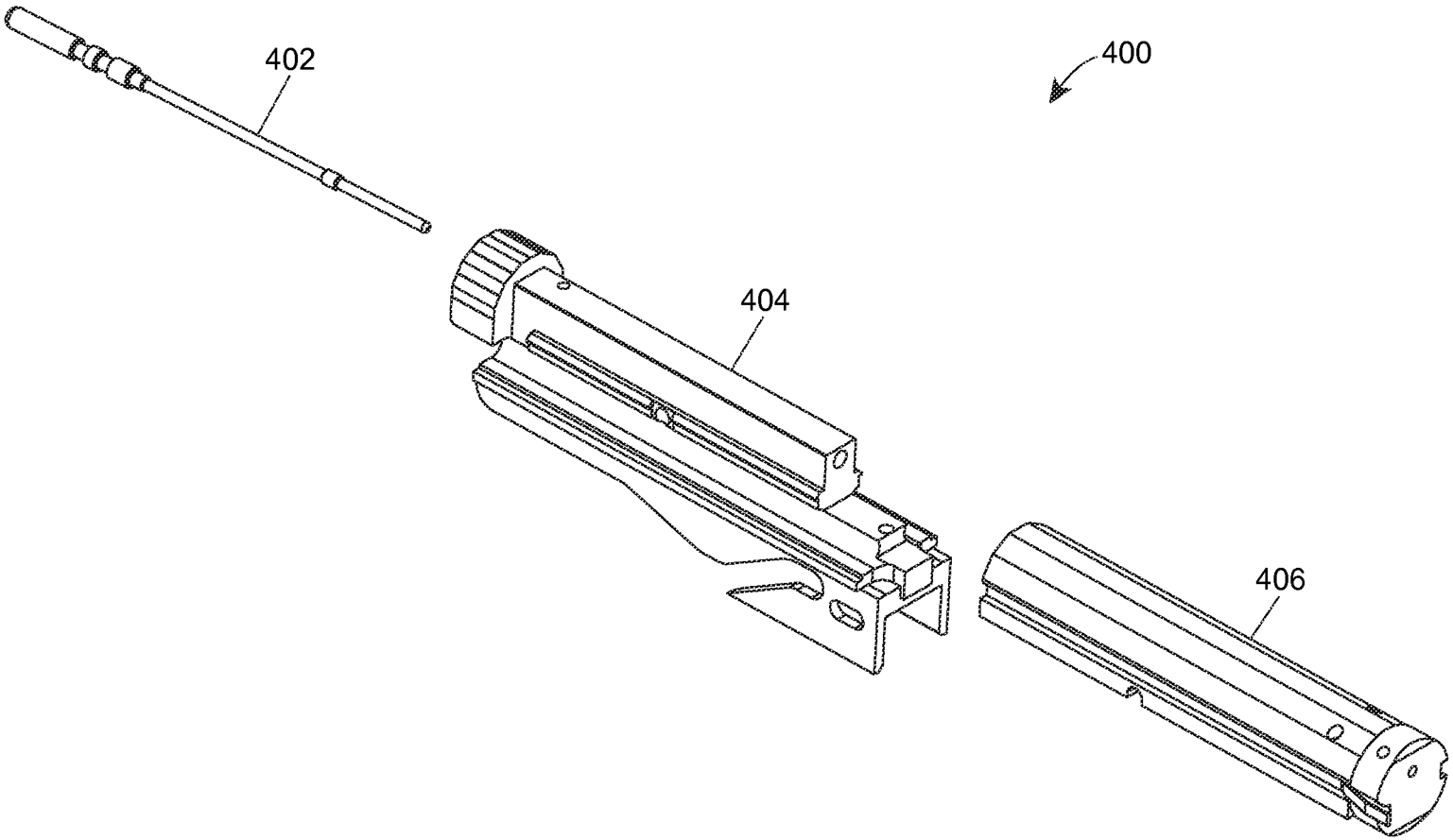
FIG. 4 is a partial view of one embodiment of a non-centerfire firing assembly for a non-centerfire shotgun capable of operating with the non-centerfire shotshell of the present invention depicted in FIG. 1.

FIG. 4 depicts one embodiment of a non-centerfire firing assembly 400 for a non-centerfire mechanical device, for example, pump action shotgun, semi-automatic shotgun; capable of cooperating with the non-centerfire shotshell of the present invention described herein. The firing assembly 400 includes a striker 402, for example, a firing pin; and a bolt 406, wherein the firing pin 402 is longitudinally positioned through the bolt 406. The firing assembly may also include a bolt carrier 404 capable of being operatively coupled to the bolt 406. The firing assembly 400 is configured to align the firing pin 402 to strike the non-centerfire primer assembly of the non-centerfire shotshell in response to the actuation of a trigger assembly (not shown) operatively coupled to the non-centerfire firing assembly 400. For example, the firing assembly 400 may be configured to cooperate with one or more known firearm assemblies, e.g., receiver assembly, trigger assembly, and barrel assembly; of the shotgun to align the firing pin for contact with the non-centerfire primer assembly of a loaded non-centerfire shotshell. For the ringfire shotshell depicted in FIGS. 1 and 2, the head of the firing pin 402 is aligned to impact the strike portion of the primer cap 202, primer compound 204, and the incendiary portion 210 of the annular primer assembly 106, 200 of the loaded shotshell. For the rimfire shotshell depicted in FIG. 3, the firing pin 402 is aligned to impact the rim 303 and primer compound 308 encased therein.

In either non-centerfire shotshell embodiment described herein, the alignment of the firing pin 402 of the non-centerfire firing assembly 400 with the non-centerfire shotshell may be anywhere along the annular primer compound. Additionally, it is readily apparent that the "off-center" position of the firing pin 402 with respect to the bolt 406 of the non-centerfire firing assembly 400 shown in FIG. 4, as well as the center of a loaded non-centerfire shotshell, would not be aligned with a conventional center-fire primer of a conventional centerfire shotshell when loaded in a shotgun incorporating the non-centerfire firing assembly 400 of the present invention. The non-centerfire bolt-assembly 400 depicted in FIG. 4 is therefore incapable of being used to fire a conventional centerfire shotshell.

Figure 5:
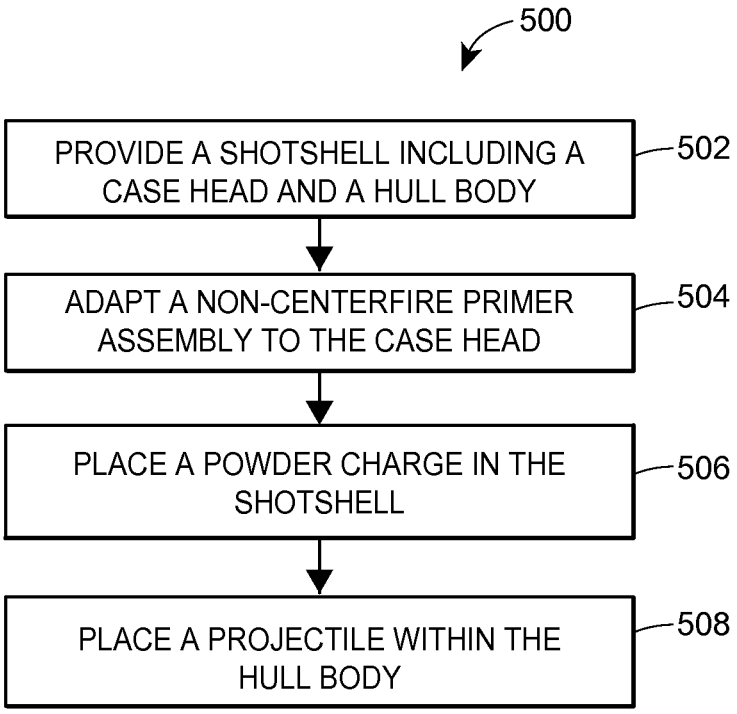
FIG. 5 is a flow diagram of one embodiment of a method for manufacturing the non-centerfire shotshell of the present invention described herein

FIG. 5. is a flow diagram of an example method for assembling one embodiment of the non-centerfire shotshell of the present invention. Each component of the non-centerfire shotshell may be manufactured separately by any known means of manufacturing ammunition components and the like and then assembled into the shotshell using any known means of manufacturing ammunition and the like. The method 500 includes providing a shotshell having a case head and a hull body (block 502). A non-centerfire primer assembly is adapted to the case head (block 504). The non-centerfire primer assembly may be partially and/or fully constructed before, during, or after being affixed and/or integrated with the case head. For the ringfire primer assembly, an assembled primer cap, primer compound, and primer base may be inserted into the case head. Alternatively, the primer cap may first be inserted into the case head, followed by the primer compound being inserted to the primer cap and/or primer base, and then the primer base being attached to the primer cap and/or case head. Similarly, the case head and hull body of the shotshell may be attached together before, during, or after any point during the construction of the non-centerfire primer assembly. For the rimfire primer assembly, the primer compound may be disposed into the rim of the case head that is attached or unattached to the hull body. Alternatively, the base wad may be inserted into the case head that is attached or unattached to the hull body.

A powder charge is placed in the shotshell (block 506). The powder charge may be of a type and amount sufficient for lethal or less-lethal purposes. Depending on the desired application of the shotshell, a lethal or less-lethal projectile is placed within the hull body (block 508). Additionally, a wad may be positioned within the hull body between the powder charge and the projectile.

It is to be understood that the size of the shotshell and/or firing assembly described herein is dependent upon the manufacturer. For example, the non-centerfire shotshell and/or non-centerfire firing assembly may be sized for use with any standard or customized shotshell size, type, and/or gauge, e.g., 100, 12G, 200, 28G, high brass and/or low brass loads. In addition, the projectile of the shotshell may be of any size and/or type, e.g., less lethal non-metal shot and/or slugs, bean bags.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "operatively coupled" and "operatively connected" along with their derivatives. For example, some embodiments may be described using the term "operatively coupled" to indicate that two or more elements are in direct physical contact. The term "operatively coupled," however, may also mean that two or more elements are not in direct contact with each other, but yet still cooperate or interact with each other in an operative manner. The embodiments are not limited in this context.

Additionally, some embodiments may be described using the expression "cooperative," cooperative operation," and "operative cooperation" along with their derivatives. For example, some embodiments may be described using the term "operatively cooperative" to indicate that two or more elements are coupled and cooperate in an manner to achieve an intended effect, as expected. The embodiments are not limited in this context.

As used herein, the terms "comprises," "comprising," "includes," "including," "has," "having" or any other variation thereof, are intended to cover a non-exclusive inclusion.

For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

It should also be understood that, unless a term is expressly defined in this patent using the sentence, "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Further, unless a claim element is defined by reciting the word "means" and a function without the recital of any structure, it is not intended that the scope of any claim element be interpreted based on the application of 35 U.S.C. §112, sixth paragraph.

Although the foregoing text sets forth a detailed description of numerous different embodiments, it should be understood that the scope of the patent is defined by the words of the claims set forth at the end of this patent. The detailed description is to be construed as exemplary only and does not describe every possible embodiment because describing every possible embodiment would be impractical, if not impossible. Numerous alternative embodiments could be implemented, using either current technology or technology developed after the filing date of this patent, which would still fall within the scope of the claims. By way of example, and not limitation, the disclosure herein contemplates at least the following aspects:

Aspect 1: A shotshell for cooperative operation with a non-centerfire shotgun including a non-centerfire firing assembly, the shotshell comprising a case head including a non-centerfire primer assembly; a hull body attached to the case head; a powder charge disposed within the shotshell proximate the non-centerfire primer assembly; and a projectile housed within the hull body, wherein the powder charge is capable of being ignited when the non-centerfire shotshell is loaded within the non-centerfire shotgun and the non-centerfire primer assembly is struck by the non-centerfire firing assembly.

Aspect 2: The shotshell of aspect 1, wherein the non-centerfire primer assembly includes a primer compound disposed between a primer cap and a primer base.

Aspect 3: The shotshell of aspect 2, wherein the primer compound is annular.

Aspect 4: The shotshell of any one of aspects 2-3, wherein the primer cap includes a strike portion for engagement with the non-centerfire firing assembly.

Aspect 5: The shotshell of aspect 4, wherein the strike portion of the primer cap is annular.

Aspect 6: The shotshell of any one of aspects 2-5, wherein the primer base includes an inert portion and wherein substantially no primer compound lies between the inert portion and the primer cap.

Aspect 7: The shotshell of any one of aspects 2-6, wherein the primer base includes an incendiary portion including at least one through-hole that facilitates positioning of the powder charge proximate the primer compound.

Aspect 8: The shotshell of aspect 7, wherein the incendiary portion of the primer base includes at least one dimple that facilitates compression of the primer compound when the primer cap is struck by the non-centerfire firing assembly.

Aspect 9: The shotshell of any one of aspects 7-8, wherein the incendiary portion of the primer base is annular.

Aspect 10: The shotshell of aspect 1, further comprising a wad disposed within the hull body proximate the powder charge and the projectile.

Aspect 11: The shotshell of aspect 1, wherein the non-centerfire primer assembly includes a primer compound and a slotted base wad proximate the primer compound, the slotted base wad including a slot facilitating positioning of the powder charge proximate the primer compound.

Aspect 12: The shotshell of aspect 11, wherein the primer compound is annularly disposed within the case head and proximate a rim of the case head.

Aspect 13: The shotshell of any one of aspects 1-12, wherein the projectile includes a less-lethal material.

Aspect 14: The shotshell of aspect 13, wherein the less lethal material includes any of the following: rubber, polymer, and textile.

Aspect 15: The shotshell of any one of aspects 1-14, wherein the hull body includes an exterior surface including a visible and/or tangible identifier indicating less-lethal capability and/or applicability.

Aspect 16: The shotshell of aspect 15, wherein the visual and/or tangible identifier includes any of the following: color, symbol, and textured pattern.

Aspect 17: A non-centerfire firing assembly for facilitating use of a non-centerfire shotshell having a non-centerfire primer assembly with a shotgun having a trigger assembly, the firing assembly comprising: a bolt; and a striker extending through the bolt, wherein the bolt is configured to align the striker for striking the non-centerfire primer assembly of the non-centerfire shotshell when the non-centerfire shotshell is loaded in the shotgun and in response to actuation of the trigger assembly.

Aspect 18: The firing assembly of aspect 17, further comprising a bolt carrier operatively coupled to the bolt.

Aspect 19: A non-centerfire shotgun for firing a non-centerfire shotshell including a non-centerfire primer assembly in response to actuation of a trigger assembly, the non-centerfire shotgun comprising: a firing assembly configured to align a striker for striking the non-centerfire primer assembly of the non-centerfire shotshell when the non-centerfire shotshell is loaded in the shotgun.

Aspect 20: The shotgun of aspect 19, wherein the firing assembly includes a bolt, and wherein the striker extends through the bolt.

Aspect 21: The shotgun of aspect 20, wherein the firing assembly includes a bolt carrier operatively coupled to the bolt.

Aspect 22: A method of manufacturing a less-lethal non-centerfire shotshell for use with a shotgun including a non-centerfire firing assembly, the method comprising: providing a shotshell including a case head and a hull body; adapting a non-centerfire primer assembly to the case head; disposing a powder charge within the shotshell; and disposing a projectile within the hull body.

Aspect 23: The method of aspect 22, wherein adapting a non-centerfire primer assembly to the case head includes: providing a primer cap and a primer base, the primer base including an annular incendiary portion positioned about an inert portion; disposing a primer compound proximate the annular incendiary portion of the primer base; affixing the primer cap to the primer base with the primer compound encased therebetween; and inserting the non-centerfire primer assembly into the case head for cooperation with the non-centerfire shotgun.

Aspect 24: The method of aspect 23, wherein the annular incendiary portion includes at least one dimple and at least one through-hole;

Aspect 25: The method of anyone of aspects 22-24, further comprising positioning a wad within the hull body proximate the powder charge and/or the projectile.

Aspect 26: The method of any one of aspect 22 and 25, wherein adapting the non-centerfire primer assembly to the case head includes: disposing a primer compound in an annular pattern proximate a rim of the case head; placing a base wad into the case head, the base wad including a slot proximate the primer compound, wherein the slot of the base wad facilitates contact of the powder charge with the primer compound proximate the rim of the case head.

Aspect 27: The method of aspect 26, further comprising positioning a wad within the hull body proximate the powder charge and/or the projectile.

What is claimed:

1. A shotshell for cooperative operation with a non-centerfire shotgun including a non-centerfire firing assembly, the shotshell comprising:

a case head including an end with a circumference and an opening centrally located within the end for receiving a non-centerfire primer assembly;

the non-centerfire primer assembly located within the opening of the end and including an annulus incendiary portion coaxially aligned with the circumference of the case head and surrounding an inert portion centrally located within the end of the case head, wherein the annulus incendiary portion includes a primer compound and the inert portion is absent the primer compound;

a hull body proximate the case head;

a powder charge disposed within the shotshell proximate the non-centerfire primer assembly; and a projectile housed within the hull body, wherein the powder charge is capable of being ignited when the shotshell is loaded within the non-centerfire shotgun and the annulus incendiary portion of the non-centerfire primer assembly is struck by the non-centerfire firing assembly.

2. The shotshell of claim 1, wherein the non-centerfire primer assembly includes the primer compound disposed between a primer cap and a primer base, the primer base proximate to the powder charge.

3. The shotshell of claim 2, wherein the primer cap or primer base includes at least one dimple that facilitates compression of the primer compound within the non-centerfire primer assembly.

4. The shotshell of claim 3, wherein the primer base includes at least one through-hole that facilitates positioning of the primer compound proximate the powder charge.

5. The shotshell of claim 2, wherein the primer base includes at least one through-hole that facilitates positioning of the primer compound proximate the powder charge.

6. The shotshell of claim 1, further comprising a wad disposed within the hull body proximate the powder charge and the projectile.

7. The shotshell of claim 1, wherein the projectile comprising a less-lethal material including any of the following: rubber, polymer, dye, and textile.

8. The shotshell of claim 1, wherein the hull body includes an exterior surface including a visible and/or tangible identifier indicating less-lethal capability and/or applicability.

9. The shotshell of claim 8, wherein the visible and/or tangible identifier includes any of the following: color, symbol, and textured pattern.

10. A method of manufacturing a less-lethal non-centerfire shotshell for use with a shotgun including a non-centerfire firing assembly, the method comprising:

providing a non-centerfire primer assembly including an annulus incendiary portion surrounding an inert portion centrally located within the annulus incendiary portion, the annulus incendiary portion including a primer compound and the inert portion is absent the primer compound;

providing a shotshell including a case head proximate a hull body, the case head including an end with a circumference and an opening centrally located within the end for receiving the non-centerfire primer assembly;

adapting the non-centerfire primer assembly in the opening of the case head for cooperation with the non-centerfire firing assembly of the shotgun, wherein the primer compound of the annulus incendiary portion of the primer assembly is coaxially aligned with the circumference of the case head and the inert portion absent the primer compound is centrally located within the case head;

disposing a powder charge within the shotshell proximate the non-centerfire primer assembly; and disposing a projectile within the hull body.

11. The method of claim 10, further comprising disposing a wad within the hull body proximate the powder charge and/or the projectile.

12. A less-lethal weaponry kit comprising:

a shotshell for cooperative operation with a non-centerfire shotgun including a non-centerfire firing assembly, the shotshell comprising:

a case head including an end with a circumference and an opening centrally located within the end for receiving a non-centerfire primer assembly;

the non-centerfire primer assembly located within the opening of the end and including an annulus incendiary portion coaxially aligned with the circumference of the case head and surrounding an inert portion centrally located within the end of the case head, wherein the annulus incendiary portion includes a primer compound and the inert portion is absent the primer compound;

a hull body proximate the case head;

a powder charge disposed within the shotshell proximate the non-centerfire primer assembly; and a projectile housed within the hull body, wherein the powder charge is capable of being ignited when the shotshell is loaded within the non-centerfire shotgun and the annulus incendiary portion of the non-centerfire primer assembly is struck by the non-centerfire firing assembly;

the non-centerfire shotgun including a trigger assembly for operatively cooperating with the non-centerfire firing assembly, wherein the non-centerfire firing assembly comprising:

a bolt; and a striker extending through the bolt, wherein the bolt is configured to align the striker to strike the incendiary portion of the non-centerfire primer assembly of the shotshell when the shotshell is loaded in the non-centerfire shotgun and in response to actuation of the trigger assembly.

13. The less-lethal weaponry kit of claim 12, wherein the non-centerfire firing assembly includes a bolt carrier operatively coupled to the bolt.

14. The less-lethal weaponry kit of claim 12, wherein the projectile within the shotshell comprising a less-lethal material including any of the following: rubber, polymer, dye, and textile.

15. The less-lethal weaponry kit of claim 12, wherein the hull body of the shotshell comprising an exterior surface including a visible and/or tangible identifier indicating less-lethal capability and/or applicability.

16. The less-lethal weaponry kit of claim 15, wherein the visible and/or tangible identifier includes any of the following: color, symbol, and textured pattern.

17. A method for providing less-lethal force capability using a firearm, the method comprising:

providing a less-lethal shotshell for cooperative operation with a non-centerfire shotgun including a non-centerfire firing assembly, the less-lethal shotshell comprising:

a case head including an end with a circumference and an opening centrally located within the end for receiving a non-centerfire primer assembly;

the non-centerfire primer assembly located within the opening of the end of the case head and including an annulus incendiary portion coaxially aligned with the circumference of the case head and surrounding an inert portion centrally located within the end of the case head, wherein the annulus incendiary portion includes a primer compound and the inert portion is absent the primer compound;

a hull body proximate the case head;

a powder charge disposed within the less-lethal shotshell proximate the non-centerfire primer assembly; and a projectile housed within the hull body, wherein the powder charge is capable of being ignited when the less-lethal shotshell is loaded within the non-centerfire shotgun and the annulus incendiary portion of the non-centerfire primer assembly is struck by the non-centerfire firing assembly; and providing the non-centerfire shotgun including a trigger assembly for operatively cooperating with the non-centerfire firing assembly, the non-centerfire firing assembly comprising:

a bolt; and a striker extending through the bolt, wherein the bolt is configured to align the striker to strike the incendiary portion of the non-centerfire primer assembly of the less-lethal shotshell when the less-lethal shotshell is loaded in the non-centerfire shotgun and in response to actuation of the trigger assembly.

18. The method of claim 17, wherein the non-centerfire firing assembly includes a bolt carrier operatively coupled to the bolt.

19. The method of claim 17, wherein the projectile within the less-lethal shotshell comprising a less-lethal material including any of the following: rubber, polymer, dye, and textile.

20. The method of claim 17, wherein the hull body of the less-lethal shotshell comprising an exterior surface including a visible and/or tangible identifier indicating less-lethal capability and/or applicability.

21. The method of claim 20, wherein the visible and/or tangible identifier includes any of the following: color, symbol, and textured pattern.

22. The method of claim 17, further comprising:

loading the less-lethal shotshell into the non-centerfire shotgun.

23. The method of claim 22, further comprising:

actuating the trigger assembly to fire the projectile from the non-centerfire shotgun.

* * * * *